US008555898B1

(12) United States Patent
Byrd

(10) Patent No.: US 8,555,898 B1
(45) Date of Patent: Oct. 15, 2013

(54) FRENCH BRAIDING TEMPLATE

(76) Inventor: Cheryl L. Byrd, Kingwood, WV (US)

( * ) Notice: Subject to any disclaimer, the term of this patent is extended or adjusted under 35 U.S.C. 154(b) by 0 days.

(21) Appl. No.: 13/570,590

(22) Filed: Aug. 9, 2012

(51) Int. Cl.
*A45D 7/00* (2006.01)
*A45D 7/02* (2006.01)

(52) U.S. Cl.
USPC ..... 132/200; 132/212

(58) Field of Classification Search
USPC ..... 132/200, 273, 212, 276–279, 275, 219, 132/142
See application file for complete search history.

(56) References Cited

U.S. PATENT DOCUMENTS 1,724,249 A 8/1929 Baldwin
2,930,385 A 3/1960 Fees
4,993,438 A 2/1991 Hunt
5,454,385 A * 10/1995 George ..... 132/273
5,497,795 A 3/1996 Hibbard
5,518,011 A 5/1996 Nash
5,558,104 A 9/1996 Clouser
5,564,445 A 10/1996 Query
5,655,550 A 8/1997 Keating
5,937,868 A * 8/1999 Ogunro ..... 132/213.1
6,041,792 A 3/2000 Kennedy
2007/0283976 A1 * 12/2007 Adams ..... 132/133

* cited by examiner

*Primary Examiner* — Robyn Doan
(74) *Attorney, Agent, or Firm* — Montgomery Patent & Design; Robert C. Montgomery

(57) ABSTRACT

A French braiding template for forming a French braid is disclosed. The template includes a body having a slightly curved upper portion to match the profile of a user's head. The upper portion has a plurality of teeth to help hold the template in place during use. Side portions include a plurality of notches and teeth. The notches indicate the proper location for the placement of hair strands during use while the side teeth help hold hair in place.

8 Claims, 2 Drawing Sheets

FRENCH BRAIDING TEMPLATE

RELATED APPLICATIONS

Not Applicable

FIELD OF THE INVENTION

The presently disclosed subject matter is directed toward hair care products. More particularly, the present invention relates to a template for forming French braids.

BACKGROUND OF THE INVENTION

The personal style and fashion industry is a large, growing, and constantly evolving industry. One (1) reason for this is that people continually strive to create and maintain their own personal look, style, and identity, while also keeping in tune with the latest trends as they hit the fashion scene.

Not the least facet of the personal style and fashion industry is the field of hair fashion and design. While hair styles frequently change, one (1) hairstyle that has been popular for a rather long time with women having long hair is the French braid. A French braid is a tight braid which encompasses all hair strands and is well suited for use outdoors, particularly in windy conditions.

While French braids are popular it can be a challenge to produce a good French Braid due to the requirements of achieving both symmetry and evenness for each braid. The challenge is even more pronounced when one attempts to produce a French braid on oneself.

Accordingly, there exists a need for a means by which the production of French braids can be simplified.

SUMMARY OF THE INVENTION

The present invention provides a means by which the production of French braids can be simplified. It can be used on others or on oneself to help produce the braid symmetry and evenness required for a good French braid.

A device in accord with the present invention has the general overall shape of a three to four inch (3-4 in.) wide, eight inch (8 in.) tall letter "T." The upper portion of the "T" is slightly curved to match the profile of a wearer's head and includes a series of teeth to help hold it in place. The bottom portion of the "T" is provided with a square saw-tooth design and in use is placed along the rear center portion of the wearer's head. Each individual saw tooth has internal teeth to help hold hair in place.

A user simply places the invention on a wearer's head (either their own or another person's) and begins French braiding hair using the invention to guide the production of symmetrical and centered French braids. While the invention is left in place under the hairstyle it is not visible from the exterior as it is covered by hair. It is also envisioned that the invention would serve as a learning tool whereupon it would not be needed at a future date after sufficient practice has occurred. It is envisioned that the invention would be one-size-fits-all and would be suitable for all ages of users. The use of the French Braiding Template provides the ability to produce French braid hairstyles in a manner which is not only quick, but easy and fashionable.

A template for making French braids that is in accord with this invention includes an elongated intermediate portion having a centerline. The intermediate portion includes a plurality of notches that define a plurality of dividers. Within each notch is a plurality of side teeth. The template further includes an upper portion that is integral with the intermediate portion and that extends symmetrically outward in an arcuate shape from the centerline. The upper portion has a plurality of upper teeth. The template further includes a lower portion that is integrally molded with the intermediate portion and that extends perpendicularly from the intermediate portion. In use the upper teeth engage a wearer's hair when the template is being used.

Beneficially the arcuate shape matches the contour of a head, the intermediate portion has complementary opposing sides, the plurality of side teeth are integrally molded with the intermediate portion, and the dividers are equally spaced along the intermediate portion.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | French braiding template |
| 11 | user |
| 12 | hair |
| 21 | upper portion |
| 22 | upper teeth |
| 24 | intermediate portion |
| 25 | notch |
| 26 | side teeth |
| 27 | divider |
| 28 | lower portion |

DETAILED DESCRIPTION OF THE PREFERRED EMBODIMENT

Figure 1:
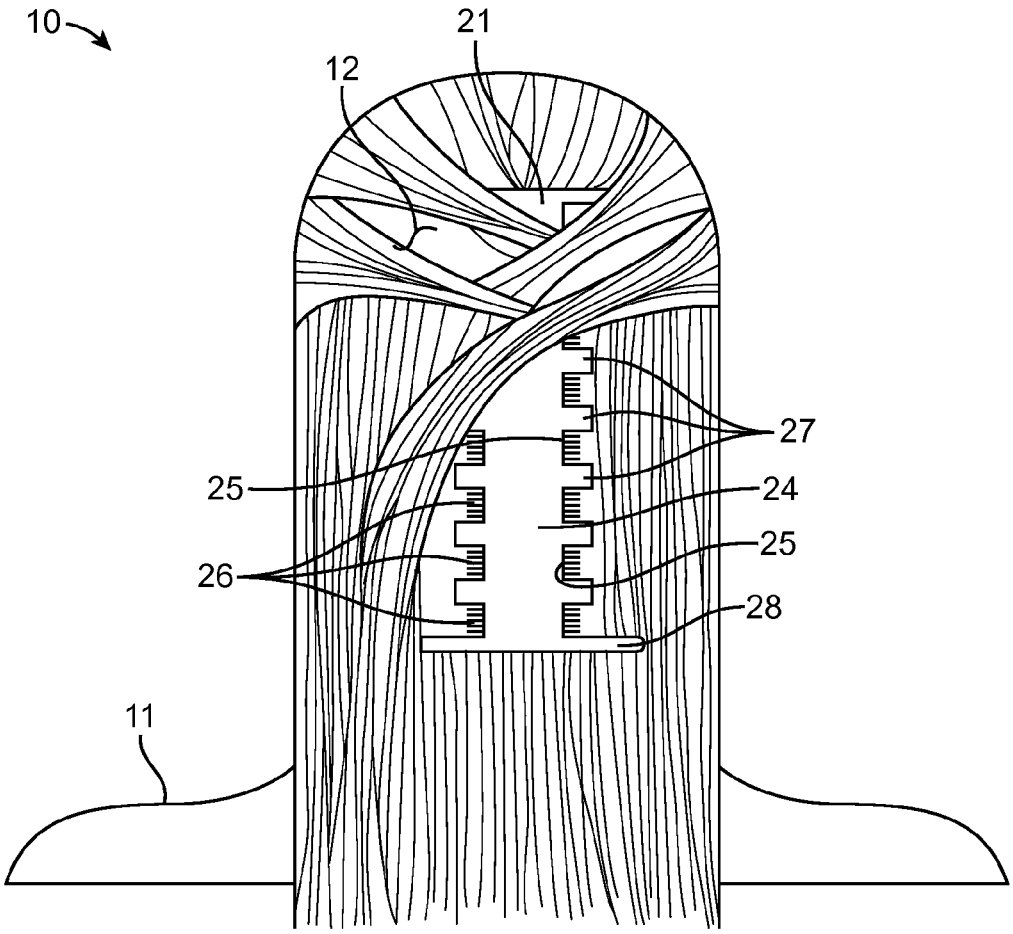
FIG. 1 is an environmental view of a French braiding template 10 that is in accord with the present invention; and, FIG. 2 is a perspective view of the French braiding template 10 shown in FIG. 1.
Figure 2:
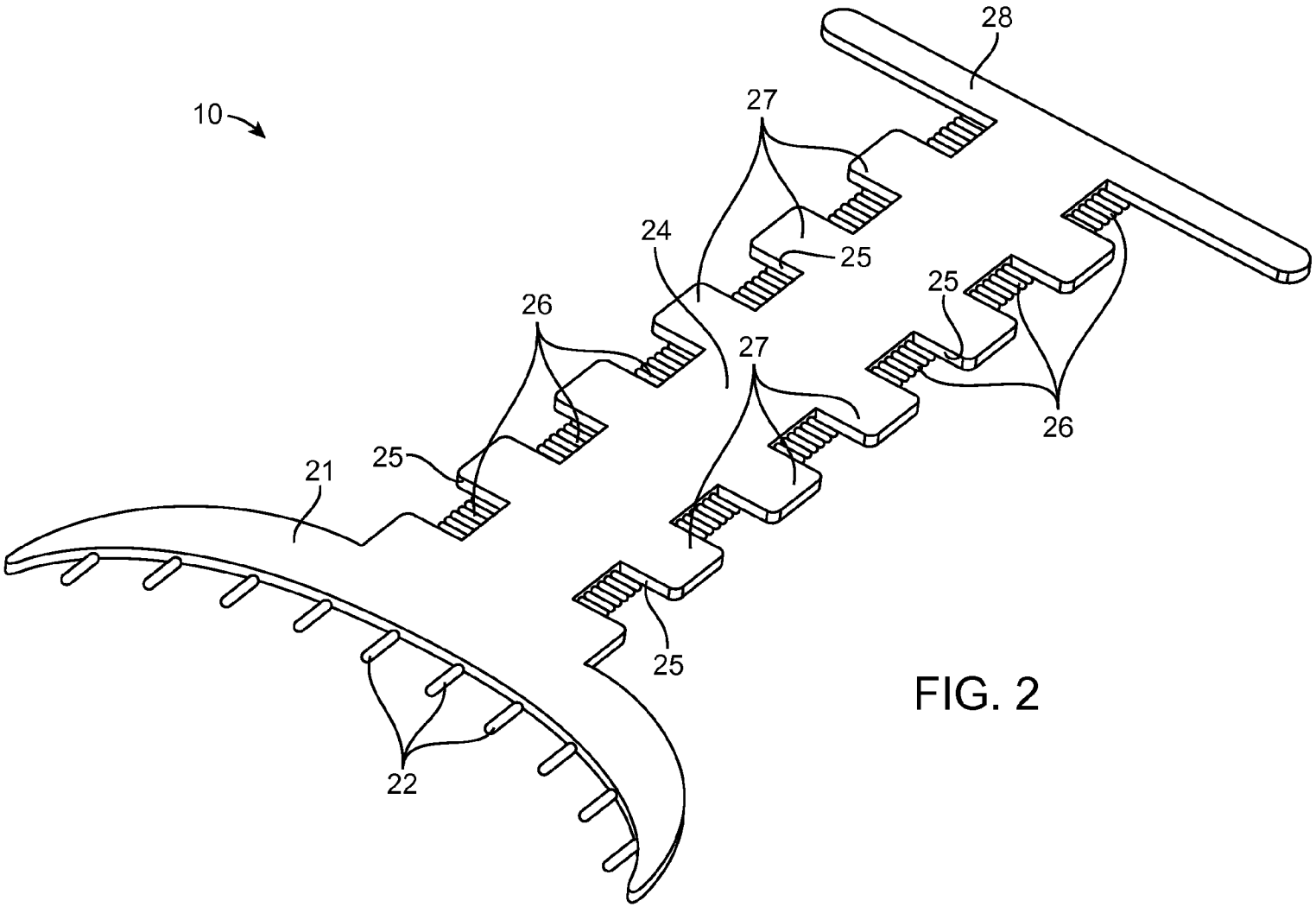

The best mode for carrying out the invention is presented in terms of its preferred embodiment, herein depicted within FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a French braiding template (herein described as the "template") 10 which assists in creating French braids.

Referring now to FIG. 1, an environmental view of the template 10 in use, the template 10 is placed within the hair 12 of a wearer 11 to simplify the production of the perfect French braid. The template 10 is beneficially fabricated from a thin plastic or metal material and measures approximately eight inches (8 in.) in length by three inches (3 in.) in width. The template 10 includes an upper portion 21, an intermediate portion 24, and a lower portion 28. The upper portion 21 is preferably placed on an upper intermediate location within a rear portion of the hair 12 which enables the lower portion 28 to be positioned toward the shoulder region of the wearer 11. The hair 12 is crisscrossed repeatedly downward toward the shoulder region to form a French braid.

FIG. 2 represents a perspective view of the template 10 according to the preferred embodiment of the present invention. The intermediate portion 24 is elongated along a center axis. The upper portion 21 in integral with the intermediate portion and extends symmetrically outward from the centerline of the intermediate portion 24 but in a slightly arcuate shape relative to the intermediate portion 24. The arcuate shape is designed to match the contour of the shape of the head of the wearer 11. The upper portion 21 has a plurality of upper teeth 22 that hold the template in position during weaving hair 12 weaving. The upper teeth 22 operate similarly to the teeth of a hair comb. The upper teeth 22 are integrally molded to the upper edge of the upper portion 21 and extend outwardly.

The intermediate portion 24 is an elongated member having complementary opposing sides having a plurality of notches 25. Within each notch is a plurality of side teeth 26 that extend away from the intermediate portion 24. The side teeth 26 are integral to the inner surface of the notches 25. The notches 25 define a plurality of dividers 27 that protrude outwardly.

In use the notches 25 provide an area for hair 12 to be positioned while the side teeth 26 hold the hair 12 in the desired crisscrossed pattern. The dividers 27 are beneficially equally-spaced and separate each braid section of crisscrossed hair 12 to provide the French braid appearance.

The lower portion 28 is integral with and perpendicular to the intermediate portion 24. Beneficially the lower portion 28 is also symmetrical with the centerline of the intermediate portion 24. The lower portion 28 enables the last sections of hair 12 to be secured. The lower portion 28 holds the template 10 within the hair 12 and is comprised of a pair of opposing generally rectangular members. In use, the lower portion 28 may be tucked and hidden within the hair 12.

It is envisioned that other styles and configurations of the present invention can be easily incorporated into the teachings of the present invention; only one particular configuration is shown and described for purposes of clarity and disclosure and not by way of limitation of scope.

The preferred embodiment of the present invention can be utilized by the common user in a simple and effortless manner with little or no training. After initial purchase or acquisition of the template 10; inserting the upper teeth 22 into an upper part of the hair 12; gathering a first section of hair 12 from the left or right side and crossing the hair 12 to an opposing notch 25; enabling the first section of hair 12 to be secured with the respective side teeth 26 and with the first section of hair 12 secured the hair 12 can be wrapped to a back surface of the template 10; gathering a second section of hair 12 from the opposing side of the previously crossed first section of hair 12 and crossing the second section of hair 12 to another opposing notch 25; enabling the second section of hair 12 to be secured with the respective side teeth 26 and with the second section of hair 12 secured the hair 12 can be wrapped to a back surface of the template 10; and repeating the above steps until each notch 25 has been used with a new section of hair 12.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A template for making French braids, comprising:

an intermediate portion having an elongated centerline and complementary sides, wherein each side having a plurality of side notches define a plurality of dividers, a plurality of integrally molded side teeth extend into each side notch;

an upper portion integral with said intermediate portion and that extends in an arcuate shape symmetrically outward from the centerline;

a plurality of integral upper teeth extending from an edge of said upper portion; and, a lower portion integrally molded with and extending perpendicularly from said intermediate portion;

wherein said upper teeth are fabricated to engage a wearer's hair when said template is in use.

2. The template according to claim 1, wherein said arcuate shape fits the contour of the back of a head.

3. The template according to claim 1, wherein said upper teeth is integrally molded with said upper portion.

4. The template according to claim 1, wherein said dividers is equally spaced along said intermediate portion.

5. The template of claim 1, wherein said template is fabricated from a thin plastic or metallic material.

6. The template of claim 1, wherein said template is approximately eight inches in length and three inches in width.

7. A method of making French braids, comprising:

a.) obtaining a French braid template having an upper portion with a plurality of upper teeth an intermediate portion having an elongated centerline and a plurality of side notches that define a plurality of dividers, further including integrally molded side teeth that extend into each side notch, and a lower portion integrally molded with and extending perpendicularly from said intermediate portion;

b.) inserting the upper teeth into a wearer's hair;

c.) gathering a first section of hair from one side and crossing the hair to an opposing side notch;

d.) securing the first section of hair with respective side teeth;

e.) gathering a second section of hair from the opposing side and crossing the second section of hair to an opposing side notch;

f.) securing the second section of hair with respective side teeth; and, g.) repeating steps b through f until each side notch has been used with a new section of hair.

8. The method of making French braids according to claim 7, further including a step h performed between step d and step e, wherein step h includes wrapping the first section of hair around to the back surface of the French braid template.

* * * * *